US005799732A

United States Patent [19]

Gonzalez et al.

[11] Patent Number: 5,799,732

[45] Date of Patent: Sep. 1, 1998

[54] SMALL HOLE RETRIEVABLE PERFORATING SYSTEM FOR USE DURING EXTREME OVERBALANCED PERFORATING

[75] Inventors: Jose Antonio Gonzalez; Joseph Matthew Marks, both of Laredo, Tex.

[73] Assignee: Schlumberger Technology Corporation, Sugar Land, Tex.

[21] Appl. No.: 595,105

[22] Filed: Jan. 31, 1996

[51] Int. Cl.[6] ..... E21B 43/263; E21B 47/06

[52] U.S. Cl. ..... 166/250.07; 166/55.1; 166/177.5; 166/297; 166/308

[58] Field of Search ..... 166/55, 55.1, 66, 166/177.5, 250.07, 250.1, 297, 308; 175/4.5, 4.52

[56] References Cited

U.S. PATENT DOCUMENTS

| | | | |
|---|---|---|---|
| Re. 32,755 | 9/1988 | Vann | 166/297 X |
| 2,760,581 | 8/1956 | Johnston et al. | 166/55.1 X |
| 3,273,659 | 9/1966 | Reynolds, Jr. | 166/55.1 |
| 4,074,756 | 2/1978 | Cooke, Jr. | 166/55.1 X |
| 4,488,597 | 12/1984 | Hoppe et al. | 166/55 X |
| 4,744,415 | 5/1988 | Bower | 166/66 X |
| 5,044,437 | 9/1991 | Wittrisch | 166/55.1 X |
| 5,058,673 | 10/1991 | Muller et al. | 166/187 |
| 5,131,472 | 7/1992 | Dees et al. | 166/308 |
| 5,249,461 | 10/1993 | Ponder et al. | 166/264 X |
| 5,271,465 | 12/1993 | Schmidt et al. | 166/297 |
| 5,370,187 | 12/1994 | Ferguson et al. | 166/308 |
| 5,509,482 | 4/1996 | Dillon et al. | 166/297 |

FOREIGN PATENT DOCUMENTS

| | | |
|---|---|---|
| 0 404 669 A | 12/1990 | European Pat. Off. . |
| 0 586 223 A | 3/1994 | European Pat. Off. . |

OTHER PUBLICATIONS

Manohar, et al., "Evaluating underbalanced perforating conditions", World Oil, vol. 2111, No. 5, Nov. 1, 1990, p. 47–49, 51–53,56,58,60; see p. 49, col. 2, paragraph 2–p. 51, col. 2.

*Primary Examiner*—George A. Suchfield
*Attorney, Agent, or Firm*—Gordon G. Waggett; John R. Ryberg; John B. Bouchard

[57] ABSTRACT

A slickline conveyed perforating method and apparatus is adapted to be disposed in an extremely small diameter cased borehole, especially during extreme overbalanced perforating conditions, and the apparatus includes one or more shock absorbed pressure and temperature measurement gauges adapted for measuring the pressure and temperature in the small diameter cased borehole before, during, and after the perforating operation. An "extremely small diameter" borehole is defined as a borehole which has a diameter that is always less than the diameter of any production tubing which would normally be inserted into the borehole.

9 Claims, 2 Drawing Sheets

FIG.1
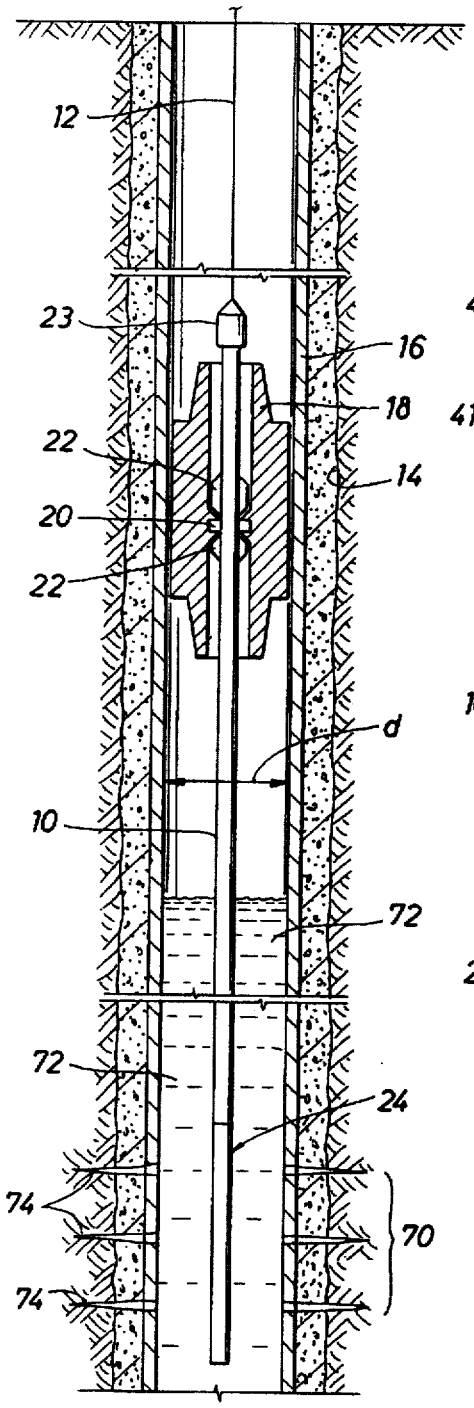
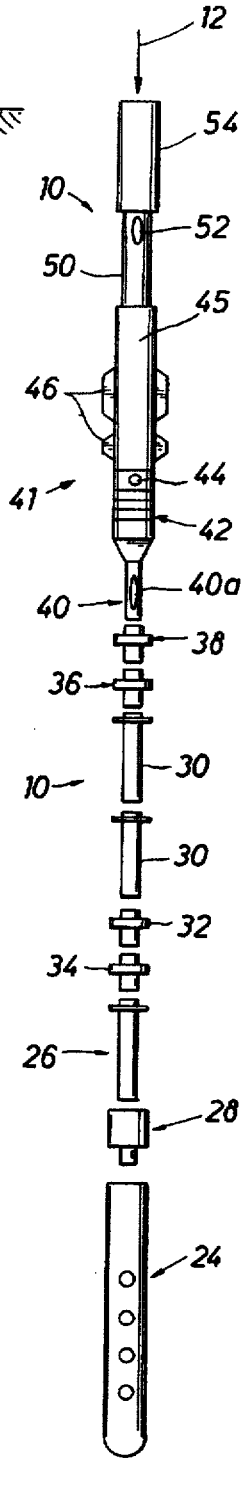
FIG. 2
FIG.3
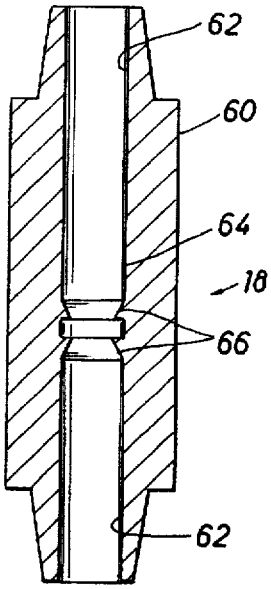

SMALL HOLE RETRIEVABLE PERFORATING SYSTEM FOR USE DURING EXTREME OVERBALANCED PERFORATING

BACKGROUND OF THE INVENTION

The subject matter of the present invention relates to a slickline conveyed perforating method and apparatus including pressure and temperature measurement gauges for recording pressure and temperature during real time extreme overbalance perforating operations in small diameter cased boreholes, such as 2⅜ inch and 2⅞ inch diameter cased boreholes.

Tubing conveyed perforating involves conveying a perforating gun into a borehole on a production tubing. The production tubing may include measurement instruments, such as gauges, for measuring the pressure and temperature of the borehole during the tubing conveyed perforating operations. In some cases, the measurement instruments are not included with the perforating gun on the production tubing because the perforating gun is subsequently dropped to a bottom of the borehole following detonation of the perforating gun. However, in all cases involving tubing conveyed perforating, the borehole diameter is always much greater than a certain amount, such as two and seven eighths (2⅞) inches in diameter, because the diameter of the production tubing, on which the perforating gun is suspended, is always much greater than that certain amount (e.g.—2⅞ inch in diameter). Therefore, because a production tubing will not fit into a borehole having a diameter of less than the certain amount (e.g. —2⅞ inch in diameter), the practice of perforating boreholes having a diameter of less than or equal to the certain amount (e.g.—2⅞ inch in diameter) has always been performed by conveying the perforating gun into the borehole via slickline or wireline (hereinafter called "slickline conveyed perforating").

When performing slickline conveyed perforating operations in small diameter boreholes, such as 2⅜ inch and 2⅞ inch diameter boreholes, pressure and temperature measurement gauges were not conveyed into the borehole along with the perforating gun because the detonation of the perforating gun would destroy the gauges. Therefore, it was necessary to perform the perforating operation in small diameter boreholes by conveying the perforating gun into the borehole on slickline or wireline, detonating the perforating gun, withdrawing the perforating gun from the borehole, and subsequently lowering a measurement gauge into the borehole for the purpose of recording pressure and temperature. As a result, "real-time" pressure and temperature data could not be acquired at points in time which occurred both prior to and immediately following the slickline conveyed perforating of the extremely small diameter boreholes, such as 2⅜ inch and 2⅞ inch diameter boreholes. As a result, the need for the measurement of real-time pressure and temperature data during perforating operations in such small diameter boreholes (that is, boreholes into which a production tubing cannot fit) is very acute, especially when performing extreme overbalance perforating operations in the small diameter boreholes.

Extreme overbalance perforating operations are adequately described in U.S. Pat. No. 5,131,472 to Dees et al, entitled "Overbalance Perforating and Stimulation Method for Wells", the disclosure of which is incorporated by reference into the specification of this application.

Accordingly, there is a need for a slickline (or wireline) conveyed perforating apparatus, which includes one or more shock absorbed pressure and temperature measurement gauges, adapted for practicing a slickline (or wireline) conveyed perforating method, especially during extreme overbalanced conditions, in extremely small diameter cased boreholes, and for measuring and recording, in real time, the pressure and temperature data in the small diameter borehole at points in time which occurred before, during, and after the slickline conveyed perforating of the small diameter cased borehole during the extreme overbalanced conditions. A "small diameter borehole" is defined as a borehole into which a production tubing cannot be inserted because the production tubing is too large for such borehole. For example, a 2⅜ inch and a 2⅞ inch diameter cased borehole is a "small diameter borehole" because a production tubing will not fit in such borehole.

SUMMARY OF THE INVENTION

Accordingly, it is a primary object of the present invention to provide a slickline or wireline conveyed perforating apparatus adapted to be disposed in an extremely small diameter cased borehole and corresponding method for performing perforating operations in the small diameter borehole and for measuring in real time the temperature and the pressure of the small diameter borehole before, during, and after the perforating operation.

It is a further object of the present invention to provide a slickline or wireline conveyed perforating apparatus adapted to be disposed in an extremely small diameter cased borehole and corresponding method for performing perforating operations in the small diameter borehole and for measuring in real time the temperature and the pressure of the small diameter borehole before, during, and after the perforating operation, the perforating apparatus including one or more temperature and pressure measurement gauges and one or more shock absorbers disposed near the gauges for absorbing a shock which results from the perforating operation and protecting the gauges from the shock, the small diameter cased borehole being defined as a borehole which has a diameter that is always less than the diameter of any production tubing which is adapted to be inserted into the borehole.

In accordance with these and other objects of the present invention, a slickline conveyed perforating method and apparatus is adapted to be disposed in an extremely small diameter cased borehole, especially during extreme overbalanced perforating conditions, and the apparatus includes one or more shock absorbed pressure and temperature measurement gauges adapted for measuring the pressure and temperature in the small diameter cased borehole before, during, and after the perforating operation. An "extremely small diameter" borehole is defined as a borehole which has a diameter that is always less than the diameter of any production tubing which would normally be inserted into the borehole.

Tubing conveyed perforating operations normally take place in boreholes which are large enough in diameter to permit a production tubing, which includes a perforating gun, to be inserted into the borehole prior to the perforating operation. However, some boreholes are so small in diameter that a production tubing cannot fit into the borehole (hereinafter called "small diameter boreholes"). In these small diameter boreholes, which are normally lined by a cement casing, perforating gun toolstrings suspend by a wireline or a slickline, and the toolstrings are lowered into the small diameter boreholes on the wireline or slickline. In the prior art, the perforating gun toolstrings, being lowered into the small diameter boreholes via wireline or slickline, did not include any pressure or temperature measurement gauges. In the prior art, after the perforating guns, suspending in the small diameter borehole via wireline or slickline, perforated the small diameter boreholes, the guns were withdrawn to a surface of the borehole, and pressure and temperature measurement gauges were subsequently lowered into the small diameter borehole for the purpose of taking pressure and temperature measurements in the borehole.

However, in accordance with the present invention, a new slickline or wireline conveyed perforating apparatus, adapted to be disposed in a small diameter borehole, includes one or more shock absorbed pressure and temperature measurement gauges adapted for measuring the pressure and temperature in the small diameter cased borehole before, during, and after the perforating operation. As a result, real time pressure and temperature data can be recorded before, during, and after the perforating operation in the small diameter (cased) borehole during one trip into the borehole.

Sometimes, an extreme overbalanced condition exists in small diameter cased borehole, of the type described in U.S. Pat. No. 5,131,472 to Dees et al, entitled "Overbalance Perforating and Stimulation Method for Wells", the disclosure of which has already been incorporated by reference into this specification. When the extreme overbalanced condition exists in the small diameter cased borehole prior to the time when the new slickline or wireline conveyed perforating apparatus of the present invention perforates the formation penetrated by the borehole, the measurement gauges of the new perforating apparatus will measure and record (i.e., store) all of the pressure and/or temperature data which occurred in the small diameter borehole starting from a time prior to perforation (when the pressure in the borehole was a maximum) until a time after perforation (when the pressure dropped and subsequent pumping occurred). This "real time" pressure and temperature data can be very useful to a wellbore operator when the new perforating apparatus is subsequently withdrawn from the small diameter borehole and the data is read from the gauges for subsequent analysis.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 1 illustrates the new slickline or wireline conveyed perforating apparatus of the present invention disposed in a small diameter cased borehole and locked in place within the borehole via a locking apparatus, known in this specification as an X-nipple;

FIG. 2 illustrates in greater detail the new slickline or wireline conveyed perforating apparatus of the present invention of FIG. 1;

FIG. 3 illustrates in greater detail the locking apparatus "X-nipple" of FIG. 1.

DETAILED DESCRIPTION OF THE PREFERRED EMBODIMENT

Figure 4:
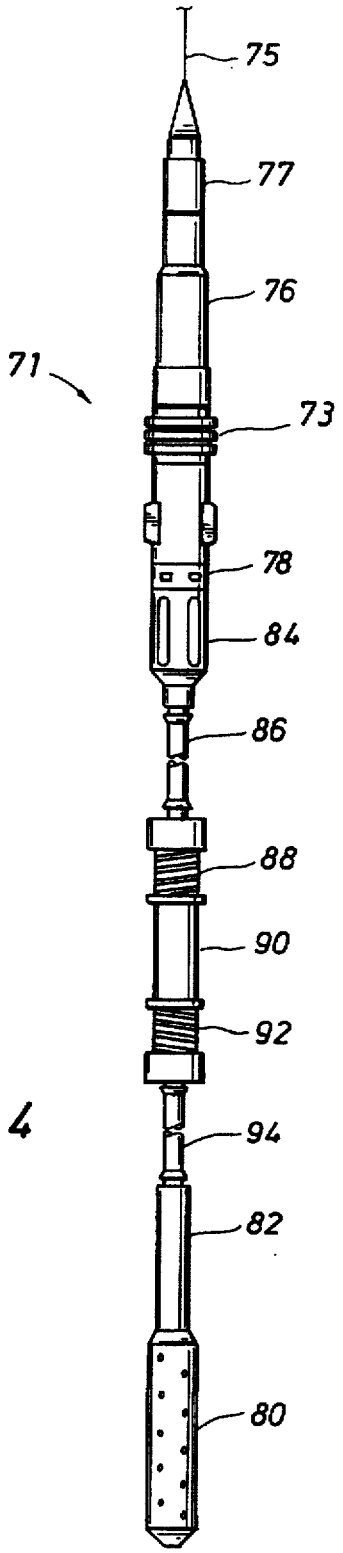
FIG. 4 illustrates an alternate embodiment of the new slickline or wireline conveyed perforating apparatus of FIG. 1, this alternate embodiment being slightly different than the embodiment shown in FIG. 2.

Referring to FIG. 1, the new slickline or wireline conveyed perforating apparatus of the present invention is illustrated, the new perforating apparatus being disposed in a small diameter cased borehole and locked in place within the borehole via an X-nipple locking apparatus.

In FIG. 1, the new slickline or wireline conveyed perforating apparatus 10 of the present invention is shown suspending by wireline or slickline 12 in a small diameter borehole 14 which is lined with a cement casing 16. The perforating apparatus 10 is lowered, by the wireline or slickline 12, into a locking apparatus 18 known as an X-nipple 18, the wireline/slickline 12 being disconnected from the perforating apparatus 10 and withdrawn to a surface of the borehole 14. In FIG. 1, when the perforating apparatus 10 is lowered inside the locking apparatus 18, the perforating apparatus 10 will be locked inside the locking apparatus 18; and, when locked inside the locking apparatus 18, a pair of locking dogs 22 on the perforating apparatus 10 will straddle a shoulder 20 on the X-nipple locking apparatus 18 thereby locking the perforating apparatus 10 in place within the X-nipple locking apparatus 18. When the perforating apparatus 10 is locked in place, by the locking apparatus 18, within the small diameter borehole 14 as shown in FIG. 1, perforating operations will commence. When perforation is complete, a fishing tool can lock onto a fishing neck 23 on the perforating apparatus 10 for the purpose of pulling the perforating apparatus 10 out of the locking apparatus 18 and withdrawing the perforating apparatus 10 to a surface of the borehole.

The "small diameter" borehole 14 is defined to be one which has a diameter that is less than the diameter of any production tubing, such as a 2⅜ inch diameter borehole or a 2⅞ inch diameter borehole. Recall that, during tubing conveyed perforating operations, a perforating gun is connected to the lower end of a production tubing, and the production tubing with attached perforating gun is lowered into a wellbore. The perforating gun on the production tubing perforates a formation penetrated by the wellbore. A "small diameter borehole", such as small diameter borehole 14 lined by casing 16 of FIG. 1, is one which has a diameter "d" that is less than the diameter of any such production tubing; and, as a result, the production tubing cannot fit into the small diameter borehole. In FIG. 1, the "small diameter" cased borehole 14, lined by casing 16, has a diameter "d" which is less than the diameter of any production tubing which would normally be inserted into the borehole for the purpose of performing tubing conveyed perforating operations.

Referring to FIG. 2, the new slickline or wireline conveyed perforating apparatus 10 of FIG. 1 of the present invention is illustrated in greater detail.

In FIG. 2, the new slickline or wireline conveyed perforating apparatus 10 includes a perforating gun 24, a firing head 26, and a firing head adaptor 28 interposed between the perforating gun 24 and the firing head 26. The gun 24 will detonate when the firing head 26 detonates. A pair of pressure and temperature measurement and recording gauges 30 are connected to the firing head 26. The gauges 30 include measurement sensors for measuring the pressure and temperature of the fluid in the borehole 14 (at points in time occurring before, during, and after perforating), and a storage apparatus including a memory for storing the measured pressure and temperature in the memory. However, a shock absorber 32 is interconnected between one end of the gauges 30 and the firing head 26, the shock absorber 32 absorbing the shock originating from the detonation of the perforating gun 24 thereby protecting the gauges 30 from the shock. A space-out apparatus 34, such as a sucker rod 34, is interconnected between the shock absorber 32 and the firing head 26 and is adapted for providing any selected distance as required between the shock absorber 32 and the firing head adaptor 28. Another shock absorber 36 is connected to the other end of the gauges 30 adapted for further absorbing any shock resultant from detonation of the perforating gun 24 thereby protecting the gauges 30 from the shock. A ported sub 40 is connected to the shock absorber 36, and another space-out apparatus 38, such as a sucker rod 38, is interconnected between the ported sub 40 and the shock absorber 36. The space out apparatus/sucker rod 38 provides additional spacing or distance, as required, between the ported sub 40 and the shock absorber 36, the sucker rods 34 and 38 collectively enabling an operator to increase or decrease the length of the toolstring of FIG. 2 associated with the new slickline or wireline conveyed perforating apparatus 10 of the present invention. The ported sub 40 includes a port **40*a* which is adapted to open and close for conducting a fluid pressure between an internal part within the ported sub 40 and an external annulus around the ported sub 40. The apparatus 41 connected to a top part of the ported sub 40 includes a packing 42, a shear pin 44, and, more importantly, a locking mandrel 45 which includes a pair of locking dogs 46. Recall that the locking dogs 46 in FIG. 2 (element numeral 22 in FIG. 1) are adapted to straddle the shoulder 20 of the locking apparatus/X-nipple 18 of FIG. 1 for the purpose of locking the toolstring of FIG. 1 inside the X-nipple 18 and thereby securely locating the new slickline or wireline conveyed perforating apparatus 10 of the present invention within the small diameter borehole. An expander mandrel 50 is connected to a top part of the apparatus 41 in FIG. 2 which includes the locking dogs 46, the expander mandrel 50 including another ported sub 52 which is also adapted to open and close for conducting a fluid pressure between an internal part within the ported sub 52 and an external annulus around the ported sub 52. A fishing neck 54 is connected to the expander mandrel 50. The fishing neck 54 is adapted to be releasably connected to a wireline or slickline 12**.

Recall that the new slickline or wireline conveyed perforating apparatus 10 of the present invention in FIG. 2 suspends by a wireline or slickline 12 prior to lowering the perforating apparatus 10 into the small diameter borehole 14 of FIG. 1 and locking the perforating apparatus 10 inside the locking apparatus 18 or X-nipple 18 of FIG. 1. When the perforating apparatus 10 is locked inside the locking apparatus 18 and securely placed in the small diameter borehole 14, the wireline or slickline 12 is detached from the perforating apparatus 10 and withdrawn to a surface of the small diameter borehole 14 prior to detonating the perforating gun 24.

When the gun 24 is detonated, and it is determined that the gun 24 should be removed from the borehole 14, a fishing tool is lowered into the borehole 14 and attached to the fishing neck 54. When the fishing tool is attached to the fishing neck 54, the fishing tool can withdraw the new slickline or wireline conveyed perforating apparatus 10 of FIG. 1 from the locking apparatus 18 and raise the perforating apparatus 10 to a surface of the small diameter borehole 14.

Referring to FIG. 3, the locking apparatus 18 or X-nipple 18 of FIG. 1 is illustrated in greater detail.

The locking apparatus 18 in FIG. 3 includes a housing 60 having a central bore 62 which is adapted to receive the new slickline or wireline conveyed perforating apparatus 10 when the apparatus 10 is lowered into the small diameter borehole 14 of FIG. 1. The central bore 62 includes an internal contour 64 which is adapted to mate with the contour of the locking dogs 46 of FIG. 2. The internal contour 64 includes a shoulder 66, similar to the shoulder 20 of FIG. 1, which is adapted to be positioned in between the pair of locking dogs 46 of FIG. 2 when the perforating apparatus 10 is fully received inside the central bore 62 of the housing 60 of the locking apparatus 18. When the perforating apparatus 10 is received inside the central bore 62, the locking dogs 46 initially retract inwardly until the shoulder 66 is firmly positioned in between the pair of locking dogs 46. When the shoulder 66 is firmly positioned in between the pair of locking dogs 46, the perforating apparatus 10 is locked inside the locking apparatus 18 and the perforating apparatus 10 is firmly secured inside the small diameter borehole 14 prior to detonation of the perforating gun 24.

Before presenting a functional description of the operation of the present invention, it is necessary to review the basic steps involved in extreme overbalanced perforating operations. For a thorough review of extreme overbalanced perforating, refer to U.S. Pat. No. 5,131,472 to Dees et al entitled "Overbalance Perforating and Stimulation Method for Wells", the disclosure of which has already been incorporated by reference into this specification.

Extreme overbalanced perforating operations actually represent a method for decreasing the resistance to fluid flow in a subterranean formation around a well having unperforated casing fixed therein, and that method includes the following steps: (1) providing a liquid in the casing opposite the formation to be treated, (2) placing a perforating apparatus (such as the perforating apparatus 10 of the present invention shown in FIG. 2) in the casing at the depth opposite the formation to be treated, (3) injecting a gas into the well until the pressure in the liquid opposite the formation to be treated will be at least as large as the fracturing pressure of the formation when the liquid pressure is applied to the formation, (4) activating the perforating apparatus (e.g., the perforating apparatus 10 of FIG. 2), and (5) at a time before the pressure in the well at the depth of the formation to be treated has substantially decreased, injecting fluid at an effective rate to fracture the formation.

A functional description of the operation of the new slickline or wireline conveyed perforating apparatus 10 of the present invention, when perforating small diameter boreholes similar to the small diameter borehole 14 of FIG. 1, especially during extreme overbalanced perforating operations, is set forth in the following paragraphs with reference to FIGS. 1 through 3 of the drawings.

Assume that the perforating apparatus 10 of FIG. 2 is being lowered into the small diameter borehole 14 of FIG. 1. The perforating apparatus 10 is lowered into the central bore 62 of the locking apparatus 18 of FIG. 3.

The borehole 14 is a "small diameter" borehole because the diameter "d" of the borehole is less than the diameter of a production tubing (recall that "tubing conveyed perforating" involves lowering a production tubing, having a perforating gun connected thereto, into a wellbore and perforating the wellbore). A liquid 72, such as clay water, is first provided within the borehole 14 and in the casing 16 at a point in the borehole 14 that is opposite the "formation to be treated". In FIG. 1, numeral 70 identifies the "formation to be treated".

The new slickline or wireline conveyed perforating apparatus 10 of FIG. 2 is lowered into the casing 16 of the small diameter borehole 14, the perforating apparatus 10 being lowered into the central bore 62 of the locking apparatus 18 of FIG. 3 until the locking dogs 46 straddle the shoulder 66 in the locking apparatus 18, at which time, the perforating gun 24 of the perforating apparatus 10 will be disposed at a depth in the small diameter borehole 14 which is opposite the formation to be treated 70.

During the time when the new perforating apparatus 10 of FIG. 2 is being lowered into the small diameter borehole 14, the pressure and temperature measurement and recording gauges 30 begin measuring, in real time, the pressure and temperature of the borehole 14, and, in particular, the pressure and temperature of the liquid 72 of FIG. 1 disposed within the casing 16 of borehole 14. Since the gauges 30 include a memory for storing the measured pressure and temperature data, the measured pressure and temperature data is instantly stored in the memory of the gauges 30.

When the perforating gun 24 of the new perforating apparatus 10 of FIG. 2 is disposed at the depth in the small diameter borehole 14 which is opposite the formation to be treated, the locking dogs 46 of the apparatus 41 of FIG. 2 straddle the shoulder 66 disposed within the bore 62 of the locking apparatus 18 (X-nipple 18) of FIG. 3, and, as a result, the new perforating apparatus 10 of FIG. 2 is firmly secured within the central bore 62 of the locking apparatus 18 of FIG. 3.

A gas is then initially injected into the small diameter borehole 14 which causes the pressure in the liquid 72 to increase. Since the liquid 72 is disposed adjacent the formation to be treated 70, as the pressure in the liquid 72 increases, the increasing pressure in the liquid 72 will be applied to the formation 70. However, when the pressure in the liquid 72 opposite the formation to be treated 70 is at least as large as the fracturing pressure of the formation to be treated 70, the injection of the gas into the small diameter borehole 14 stops and the pressure in the liquid 72 opposite the formation to be treated 70 stops increasing. At this point, the pressure in the liquid 72 opposite the formation to be treated 70 is at least as large as the fracturing pressure of the formation to be treated 70.

During the time period between the initial injection of the gas into the small diameter borehole 14 and the termination of the injection of the gas in the borehole 14 (when the pressure in the liquid 72 opposite the formation to be treated 70 is at least as large as the fracturing pressure of the formation to be treated 70), the pressure and temperature measurement and recording gauges 30 of the new slickline or wireline conveyed perforating apparatus 10 of FIG. 2 will continue to measure, in real time, the pressure and the temperature in the liquid 72 and in the borehole 14, and the measured pressure and temperature data, measured by the gauges 30, will continue to be instantly stored in the memory of the gauges 30.

At this point, the perforating gun 24 of the new slickline or wireline conveyed perforating apparatus 10 detonates thereby perforating the formation to be treated 70 of FIG. 1. The shock absorbers 32 and 36 of the new perforating apparatus 10 will absorb the shock resultant from the detonation of the perforating gun 24 (the shock absorbers 32, 36 will prevent the gauges 30 from being destroyed by the shock resultant from the detonation of the perforating gun 24).

When the formation 70 is perforated, a plurality of perforations 74 are created in the formation 70, and, as a result, the pressure in the small diameter borehole 14 at the depth in the borehole 14 opposite the formation to be treated 70 begins to decrease. However, the gauges 30 of the new perforating apparatus 10 of FIG. 2 will continue to measure and record (and store in memory) the decrease in the pressure in the liquid 72 at the depth in the borehole 14 opposite the formation to be treated 70.

At a time before the pressure in the small diameter borehole 14, at the depth of the formation to be treated 70, has substantially decreased, the pressure in the liquid 72 is purposely increased (additional gas is injected into the borehole 14). The gauges 30 of the new slickline or wireline conveyed perforating apparatus 10 of FIG. 2 will continue to measure, record, and store in memory, the increase of the pressure in the liquid 72. However, when the pressure in the liquid 72 is increased, the liquid 72 is injected into the plurality of perforations 74 disposed in the formation to be treated 70, and the injection of the liquid 72 into the perforations 74 will take place at an effective rate which will fracture the formation to be treated 70.

When the formation to be treated 70 is fractured, the pressure within the liquid 72 will decrease once again. This decrease in the pressure of the liquid 72 will again be measured, recorded, and stored in the memory of the gauges 30 of the new slickline or wireline conveyed perforating apparatus 10 of FIG. 2, and this record of the decrease in the pressure of the liquid 72 will set forth the actual pressure in the liquid 72 which was required in order to breakdown (or fracture) the formation to be treated 70.

For any borehole, and especially for small diameter boreholes like the small diameter borehole 14 in FIG. 1, it is desirable to use these gauges 30 in a shock absorbed perforating apparatus toolstring to measure and record, in real time, the continuously changing pressures and temperatures which exist in the small diameter borehole 14, especially since these continuously changing pressures are recorded in real time during a single run into the small diameter borehole 14.

Referring to FIG. 4, another embodiment of the new slickline or wireline conveyed perforating apparatus 10 of FIG. 1 is illustrated.

Recall that the locking dogs 46 in FIG. 2 (element numeral 22 in FIG. 1) are adapted to straddle the shoulder 20 of the locking apparatus/X-nipple 18 of FIG. 1 for the purpose of locking the toolstring of FIG. 1 inside the X-nipple 18 and thereby securely locating the new slickline or wireline conveyed perforating apparatus 10 of the present invention within the small diameter borehole.

However, in lieu of the locking dogs 46 of FIG. 2 and the corresponding locking apparatus X-nipple 18 in FIGS. 1 and 3, one could instead use a hydraulically set packer, such as the hydraulically set packer shown in U.S. Pat. No. 5,058,673 to Muller et al. As a result, the packer could be set and then unset. When the hydraulically set packer is unset, the new slickline or wireline conveyed perforating apparatus of FIG. 4 could be used again at a different depth in the borehole 14.

In FIG. 4, the alternate embodiment of the new slickline or wireline conveyed perforating apparatus 71, which is adapted to be disposed in a small diameter borehole (i.e., a borehole into which a production tubing cannot fit, which is typically about 2⅜ inch or 2⅞ inch in diameter), includes a hydraulically set packer 73 which replaces the locking dogs 46 of FIG. 2 (and the X-nipple 18 of FIGS. 1 and 3). In addition, the new perforating apparatus 71 includes a collar locator 77 adapted to be connected to a wireline 75, a setting tool 76 adapted for setting the hydraulically set (compression set) packer 73, a perforating gun 80 and a corresponding firing head 82, a hydraulic gun release 78 adapted for releasing the perforating gun 80 from the toolstring of FIG. 4 and dropping the perforating gun 80 to a bottom of the wellbore, a ported flow sub 84 adapted for flowing a wellbore fluid therethrough, a space out sub 86, a shock absorber 88, electronic gauges 90 similar to the gauges 30 shown in FIG. 2, another shock absorber 92, and another space out sub 94.

In operation, in FIG. 4, the function of the new slickline or wireline conveyed perforating apparatus of FIG. 4 is basically the same as the function of the new slickline or wireline conveyed perforating apparatus of FIG. 2, except that the hydraulically set packer 72 replaces the locking dogs 46 of FIG. 2 (and the X-nipple 18 of FIGS. 1 and 3). Now, by using the new wireline conveyed perforating apparatus 71 of FIG. 4 in the small diameter borehole 14 of FIG. 1, when the packer 73 is set in the borehole 14 of FIG. 1, the gauges 90 of the new perforating apparatus 71 of FIG. 4 begin to measure, and store therein, the pressure and temperature in the borehole 14, especially during overbalanced conditions, as explained above. Then, the packer 73 is unset, the new perforating apparatus 71 is lowered or raised to a different depth in the borehole 14, and the packer 73 is set once again. Then, when the new perforating apparatus 71 is disposed at the different depth in the small diameter borehole 14, the gauges 90 of the new perforating apparatus 71 measure, and store therein, the pressure and temperature conditions which exist at that new, different depth in the small diameter borehole 14, especially during overbalanced conditions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of perforating a wellbore, comprising the steps of:

(a) lowering a perforating apparatus into a small diameter wellbore, said small diameter wellbore having a diameter which is less than a diameter of a production tubing;

(b) measuring a characteristic which exists within said small diameter wellbore before the perforating step (c);

(c) perforating, by said perforating apparatus, a formation penetrated by said small diameter wellbore;

(d) measuring a characteristic which exists within said small diameter wellbore during and after the perforating step (c); and (e) retrieving said perforating apparatus from said small diameter wellbore.

2. The method of claim 1, wherein said perforating step (c) comprises the steps of:

(f) imposing extreme overbalanced conditions in said small diameter wellbore, the imposing step including the step of changing a pressure in said small diameter wellbore opposite said formation to be perforated until said pressure is at least as large as a fracturing pressure of said formation to be perforated; and (g) perforating said formation penetrated by said small diameter wellbore following the imposing step.

3. The method of claim 2, wherein the measuring step (d) includes the step of:

(h) measuring a pressure characteristic and a temperature characteristic in said small diameter wellbore, during the imposing step (f) and during the perforating step (g) when said extreme overbalanced conditions exist in said wellbore.

4. The method of claim 1, wherein said perforating apparatus includes measurement gauges, said small diameter wellbore opposite a formation to be treated contains a liquid under pressure, and wherein the measuring step (b) comprises the steps of:

(f) injecting a gas into the small diameter wellbore, a pressure in said liquid in said small diameter wellbore opposite said formation to be treated being at least as large as a fracturing pressure of said formation to be treated; and (g) measuring, by said measurement gauges of said perforating apparatus, said pressure in said liquid in said small diameter wellbore opposite said formation to be treated during the injecting step (f).

5. The method of claim 4, wherein said pressure in said liquid in said small diameter wellbore opposite said formation to be treated decreases in response to the perforating step (c), and wherein the measuring step (d) comprises the steps of:

(h) measuring, by said measurement gauges of said perforating apparatus, the decreasing pressure in said liquid in said small diameter wellbore opposite said formation to be treated.

6. The method of claim 5, wherein, at a time before said pressure in said liquid in said small diameter wellbore opposite said formation to be treated has substantially decreased, a gas is re-injected into said small diameter wellbore and said pressure in said liquid in said small diameter wellbore opposite said formation to be treated is increased in response to the re-injecting step, and wherein the measuring step (d) further comprises the steps of:

(i) measuring, by said measurement gauges of said perforating apparatus, the increasing pressure in said liquid in said small diameter wellbore opposite said formation to be treated.

7. The method of claim 6, wherein said formation to be treated is fractured in response to the increasing pressure in said liquid opposite said formation to be treated, and said pressure in said liquid in said small diameter wellbore opposite said formation to be treated is decreased when the formation to be treated is fractured, and wherein the measuring step (d) further comprises the steps of:

(j) measuring, by said measurement gauges of said perforating apparatus, the decreasing pressure in said liquid in said small diameter wellbore opposite said formation to be treated.

8. A perforating apparatus adapted to be lowered into a small diameter borehole, comprising:

connecting means for connecting said perforating apparatus to a wireline or a slickline, said perforating apparatus being suspended from said wireline or said slickline when said connecting means connects said perforating apparatus to said wireline or said slickline and said wireline or said slickline lowers said perforating apparatus into said small diameter borehole, said small diameter borehole being defined as a borehole having a diameter which is less than a diameter of a production tubing;

retaining means connected to said connecting means for retaining said perforating apparatus at a particular depth in said borehole;

measurement gauge means connected to the retaining means for measuring a pressure which exists within said borehole and storing said characteristic therein, said gauge means measuring said pressure when said perforating apparatus is lowered into said small diameter borehole; and perforating means connected to said gauge means for perforating a formation penetrated by said borehole, said gauge means measuring said pressure within said borehole at a time during the perforating of said formation and after the perforating of said formation by said perforating means.

9. The perforating apparatus of claim 8, wherein said borehole is subjected to extreme overbalanced conditions, said gauge means measuring said pressure within said borehole during said extreme overbalanced conditions.

* * * * *